US011561011B2

(12) United States Patent
Ceron et al.

(10) Patent No.: US 11,561,011 B2
(45) Date of Patent: Jan. 24, 2023

(54) ELONGATED MEMBER FOR A RACK

(71) Applicant: WHIRLPOOL CORPORATION, Benton Harbor, MI (US)

(72) Inventors: Simone Emanuele Ceron, Busto Arsizio (IT); Massimiliano Frontini, Casciago (IT); Tommaso Martini, Marostica (IT); John Jay Myers, Saugatuck, MI (US); Ezequiel Matias Varani, Varese (IT)

(73) Assignee: Whirlpool Corporation, Benton Harbor, MI (US)

( * ) Notice: Subject to any disclaimer, the term of this patent is extended or adjusted under 35 U.S.C. 154(b) by 33 days.

(21) Appl. No.: 17/147,509

(22) Filed: Jan. 13, 2021

(65) Prior Publication Data

US 2021/0222888 A1 Jul. 22, 2021

Related U.S. Application Data

(60) Provisional application No. 62/962,664, filed on Jan. 17, 2020.

(51) Int. Cl.
*F24C 15/16* (2006.01)

(52) U.S. Cl.
CPC ..... *F24C 15/16* (2013.01)

(58) Field of Classification Search
CPC ..... F24C 15/16; F24C 15/36; A47B 95/04; A47B 55/02
USPC ..... 312/410, 234, 234.4, 234.5, 350; 40/606.04; 211/153, 90.03; 126/337 R, 126/332.339
See application file for complete search history.

(56) References Cited

U.S. PATENT DOCUMENTS

| | | | | |
|---|---|---|---|---|
| 1,822,641 A * | 9/1931 | Angell | G09F 3/202 40/5 |
| 1,994,144 A * | 3/1935 | Merrill | C25C 7/02 204/281 |
| 2,169,904 A * | 8/1939 | Schweller | F25D 29/005 312/236 |
| 2,186,857 A * | 1/1940 | Davis | F24C 15/12 126/339 |
| 2,806,467 A | 9/1957 | Slaughter | |
| 3,977,389 A | 8/1976 | Ondrasik, II | |
| 5,429,377 A * | 7/1995 | Duer | B62B 5/06 150/154 |

(Continued)

FOREIGN PATENT DOCUMENTS

| | | | |
|---|---|---|---|
| CN | 106678905 | * | 5/2017 |
| DE | 8915074 U1 | | 2/1990 |

(Continued)

*Primary Examiner* — Janet M Wilkens
(74) *Attorney, Agent, or Firm* — Price Heneveld LLP

(57) ABSTRACT

A rack for a cooking appliance includes a perimeter rim that has a first end, a second end, a first side rail, and a second side rail. A plurality of spaced rails are disposed between each of the first and second rails and the first and second ends of the perimeter rim. An elongated member is operably coupled to the perimeter rim and is proximate to the plurality of spaced rails. A crossbar is disposed proximate to the elongated member. The crossbar defines an opening directly behind the elongated member along a length of the elongated member and a length of the crossbar.

18 Claims, 12 Drawing Sheets

(56) References Cited

U.S. PATENT DOCUMENTS

| | | | | |
|---|---|---|---|---|
| 6,112,916 | A * | 9/2000 | Barnes | F24C 15/16 126/339 |
| 7,347,198 | B2 | 3/2008 | Freese et al. | |
| 7,673,628 | B1 | 3/2010 | Shulman et al. | |
| 7,823,735 | B2 | 11/2010 | Dunn | |
| 8,136,899 | B2 * | 3/2012 | Osawa | C12M 23/48 211/192 |
| 8,820,314 | B1 | 9/2014 | Johnson et al. | |
| 9,587,838 | B2 | 3/2017 | Stewart et al. | |
| 9,671,115 | B2 | 6/2017 | Elkasevic | |
| 10,480,796 | B2 | 11/2019 | Trice | |
| 2004/0094143 | A1 * | 5/2004 | Bartley | F24C 15/16 211/153 |
| 2009/0064989 | A1 | 3/2009 | Shaffer | |
| 2010/0000514 | A1 * | 1/2010 | Baker | F24C 15/16 126/339 |
| 2014/0263131 | A1 * | 9/2014 | Hansel | A47B 95/04 211/183 |
| 2017/0146246 | A1 * | 5/2017 | Stewart | F24C 15/168 |
| 2019/0003723 | A1 | 1/2019 | Trice | |

FOREIGN PATENT DOCUMENTS

| | | | |
|---|---|---|---|
| EP | 3926241 | * | 12/2021 |
| GB | 2435460 | * | 8/2007 |
| GB | 2455541 B | | 6/2009 |

* cited by examiner

ELONGATED MEMBER FOR A RACK

CROSS REFERENCE TO RELATED APPLICATION

This application claims the benefit under 35 U.S.C. § 119(e) to U.S. Provisional patent Application No. 62/962,664, filed Jan. 17, 2020, entitled "ELONGATED MEMBER FOR A RACK," which is incorporated herein by reference in its entirety.

BACKGROUND OF THE DISCLOSURE

The present disclosure generally relates to a rack for a cooking appliance, and more specifically, to an elongated member for a rack for a cooking appliance.

SUMMARY OF THE DISCLOSURE

According to one aspect of the present disclosure, a cooking appliance includes a body that defines a cavity and a plurality of retention rails. A rack is operably coupled to the retention rails of the body within the cavity. The rack includes a perimeter rim that has a first end and a second end. A plurality of spaced rails are disposed between the first end and the second end of the perimeter rim, and an elongated member includes a display surface, an attachment surface, and an indicia disposed on the display surface. The elongated member is operably coupled to a central region of the first end of the perimeter rim proximate to the plurality of spaced rails via the attachment surface and divides the first end at the central region.

According to another aspect of the present disclosure, an appliance includes a body that defines a cavity and includes a first retention rail and a second retention rail. A rack has a first side rail that is operably coupled to the first retention rail, and a second retention side rail that is operably coupled to the second retention rail. The rack includes a plurality of spaced rails that are disposed between the first and second side rails of the rack. An elongated member is operably coupled to the rack that is proximate to the plurality of spaced rails. The elongated member includes an attachment surface and a display surface separated by a perimeter edge.

According to another aspect of the present disclosure, a rack for a cooking appliance includes a perimeter rim that has a first end, a second end, a first side rail, and a second side rail. A plurality of spaced rails are disposed between each of the first and second rails and the first and second ends of the perimeter rim. An elongated member is operably coupled to the perimeter rim and is proximate to the plurality of spaced rails. A crossbar is disposed proximate to the elongated member and defines an opening directly behind the elongated member along a length of the elongated member and a length of the crossbar.

These and other features, advantages, and objects of the present disclosure will be further understood and appreciated by those skilled in the art by reference to the following specification, claims, and appended drawings.

Figure 1:
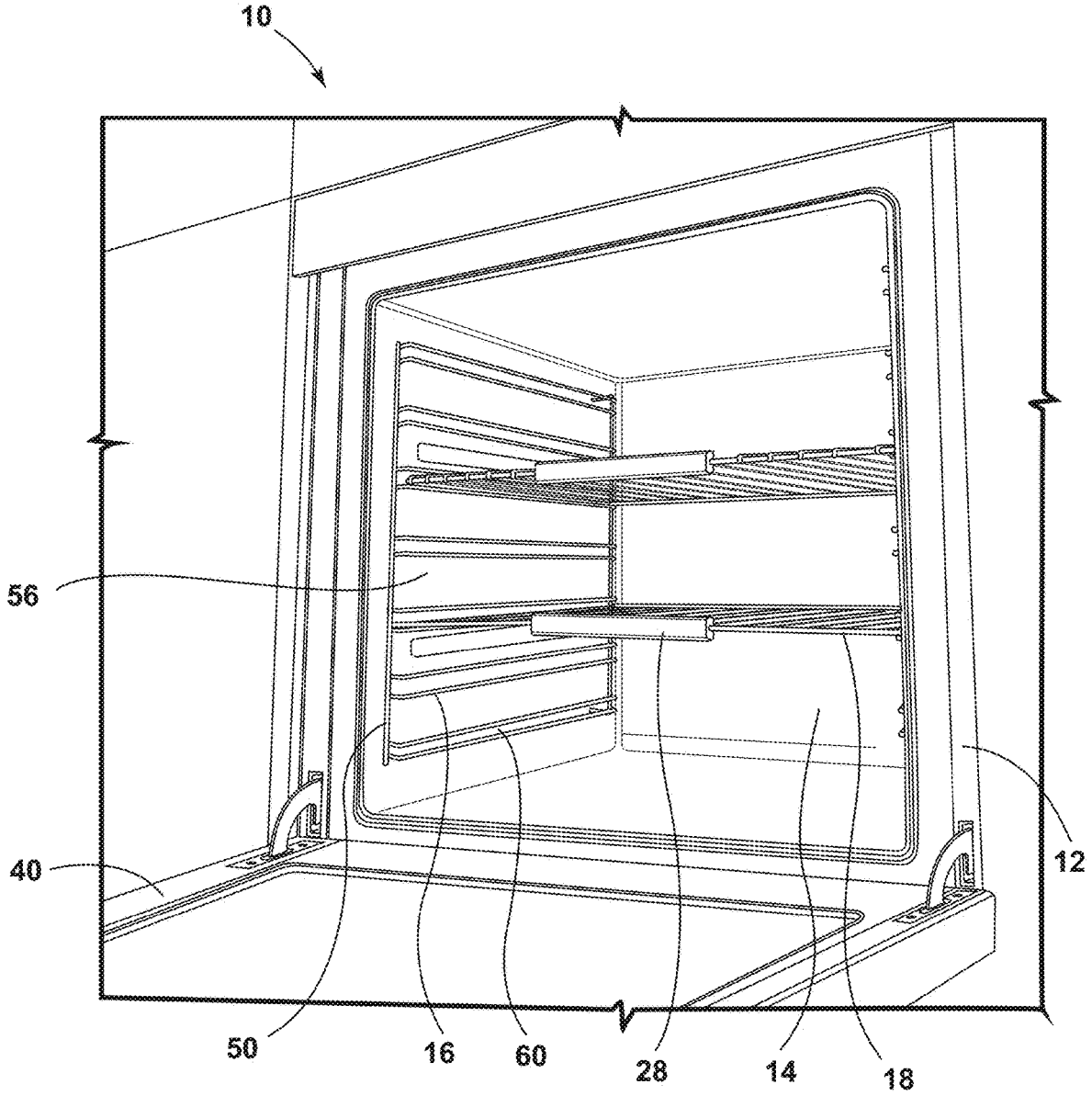
FIG. 1 is a partial enlarged view of a cooking appliance of the present disclosure.
Figure 2:
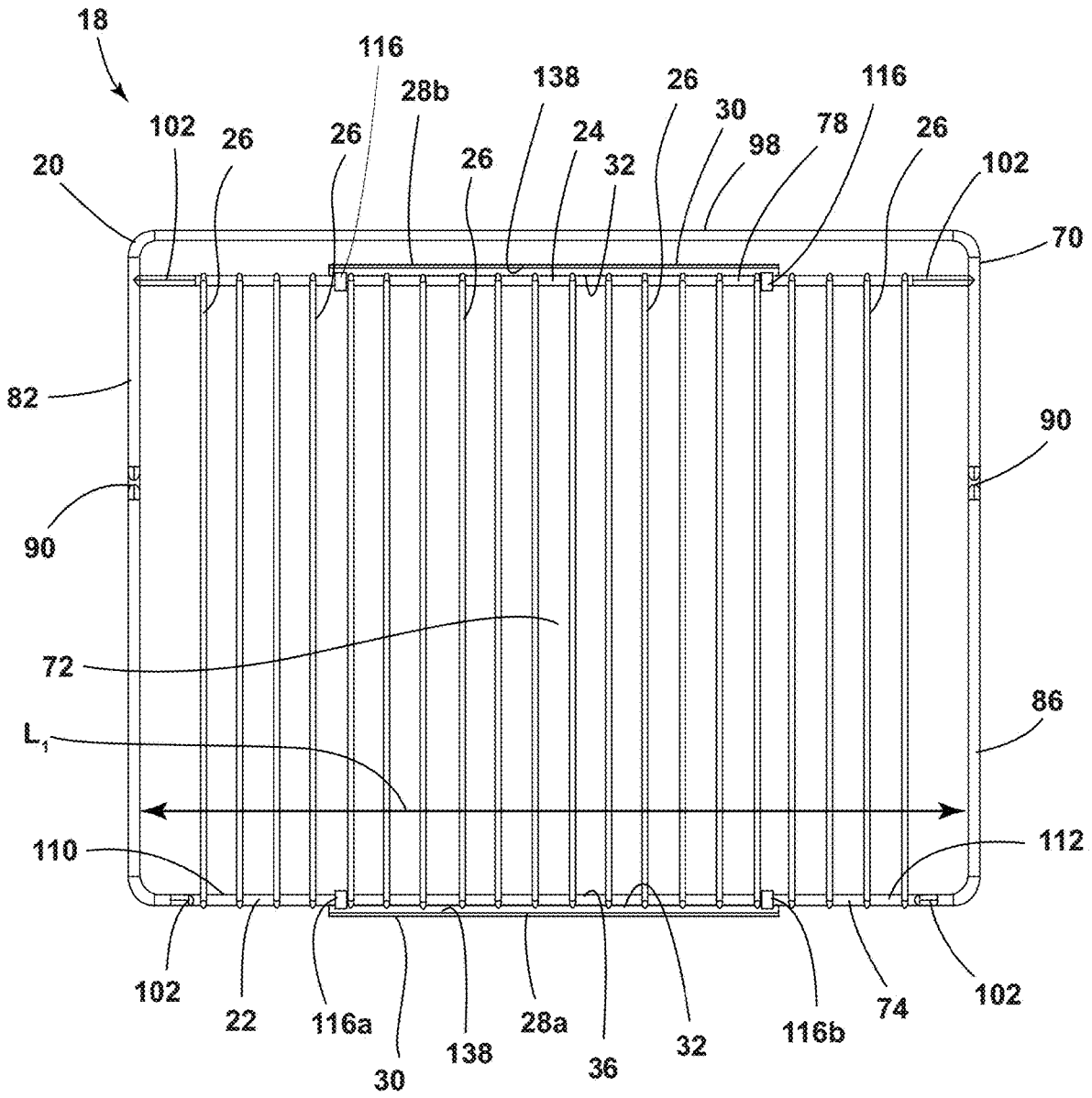
FIG. 2 is a top plan view of a rack of the present disclosure that has a first elongated member and a second elongated member.

The components in the figures are not necessarily to scale, emphasis instead being placed upon illustrating the principles described herein.

DETAILED DESCRIPTION

The present illustrated embodiments reside primarily in combinations apparatus components related to an elongated member for a rack. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-15, reference numeral 10 generally designates a cooking appliance that includes a body 12 defining a cavity 14 and a plurality of retention rails 16. A rack 18 is operably coupled to the retention rails 16 of the body 12 within the cavity 14. The rack 18 includes a perimeter rim 20 having a first end 22 and a second end 24. A plurality of spaced rails 26 are disposed between the first and second ends 22, 24 of the perimeter rim 20. An elongated member 28 includes a display surface 30, an attachment surface 32, and an indicia 34 disposed on the display surface 30. The elongated member 28 is operably coupled to a central region 36 of the first end 22 of the perimeter rim 20 proximate to the plurality of spaced rails 26 via the attachment surface 32 and divides the first end 22 at the central region 36.

Referring to FIG. 1, the rack 18 is illustrated within the cooking appliance 10. The cooking appliance 10 is illustrated as a built-in oven; however, it is also contemplated that the rack 18 may be used in other cooking appliances such as microwaves, toaster ovens, ranges, and other similar cooking appliances. As illustrated in FIG. 1, the cooking appliance 10 includes a door 40 that is operably coupled to the body 12 of the cooking appliance 10. The body 12 defines the interior cavity 14 in which first and second support racks 50, 54 vertically extend. Stated differently, the first and second support racks 50, 54 vertically extend along sidewalls 56 of the body 12 within the interior cavity 14. It is generally contemplated that the first and second support racks 50, 54 include the plurality of retention rails 16 that each define recesses 60 within which the rack 18 may be placed, as described further below.

As illustrated in FIGS. 1-6, the perimeter rim 20 generally defines a frame 70 of the rack 18. The spaced rails 26 are disposed within a central portion 72 of the rack 18 and extend between the first end 22 and the second end 24 of the perimeter rim 20, such that the spaced rails 26 are coupled to the first and second ends 22, 24. Each rail of the plurality of spaced rails 26 may extend around the first and second ends 22, 24 of the perimeter rim 20. Additionally or alternatively, each rail may be operably coupled to the first and second ends 22, 24, such that the rails 26 may abut the first and second ends 22, 24 within the central portion 72 of the rack 18. The rails 26 may be operably coupled to the perimeter rim 20 via spot welding, casting, and/or other coupling methods generally known in the art. It is generally contemplated that the first end 22 of the perimeter rim 20 corresponds to a forward crossbar 74 of the rack 18 and the second end 24 corresponds to a rearward crossbar 78 of the rack 18.

In addition, the perimeter rim 20 has first and second side rails 82, 86. As illustrated in FIGS. 2-5, each of the first and second side rails 82, 86 defines a notch 90, which further defines a projection 94. The projection 94 of each of the first and second side rails 82, 86 are configured to operably couple the rack 18 to the first and second support racks 50, 54, respectively. This coupling of the projections 94 within the recesses 60 defined by the first and second support racks 50, 54 generally retains the rack 18 within the retention rails 16, such that the rack 18 is securely, but removably, coupled to each of the first and second support racks 50, 54. It is generally contemplated that a user would at least partially raise the rack 18 so the projections 94 can pass through the recesses 60 and over the retention rails 16 when removing the rack 18 from the interior cavity 14. When the rack 18 is properly installed within the interior cavity 14, the projections 94 engage the retention rails 16 preventing horizontal removal of the rack 18. Additionally, the illustrated rack 18 includes a support rail 98, which may abut a rear portion of the body 12 within the interior cavity 14 and may provide additional structural support for the rack 18. However, the rack 18 may also be free of the support rail 98.

With further reference to FIGS. 1-6, the elongated member 28, as mentioned above, is generally coupled to at least the first end 22 of the perimeter rim 20. Typically, the elongated member 28 divides the first end 22 of the perimeter rim 20, but it is also contemplated that the elongated member 28 may extend along the first end 22 to conceal the forward crossbar 74. The elongated member 28 can be formed from materials typically used in the formation of the rack 18 including, but not limited to, stainless steel, chrome-plated carbon steel, nickel-plated steel, and other metallic materials. It is also advantageously contemplated that the elongated member 28 may be formed from an insulation material, such as silicon, to generally insulate the elongated member 28 relative to the rack 18. Additionally or alternatively, the insulation material may be disposed and/or molded onto the elongated member 28, such that the insulation material defines a layer over the elongated member 28. The use of the insulation material for the elongated member 28 may allow a user to grasp the elongated member 28 to operably move the rack 18 relative to the body 12 of the cooking appliance 10 with minimal risk of the user contacting a thermally conductive material that may be hot. Thus, the elongated member 28 may provide an easily identifiable area at which a user can contact the rack 18.

The first and second side rails 82, 86 are coupled to the forward crossbar 74 and the rearward crossbar 78 via an attachment feature 100. The attachment features 100 couple each of the first and second side rails 82, 86 to the forward and rearward crossbars 74, 78. The attachment features 100 include arcuate portions 102 that are coupled to the forward and rearward crossbars 74, 78 and a linear portion 104 coupled to the first and second side rails 82, 86. Additionally, the attachment features 100 are configured to generally elevate at least a portion of the perimeter rim 20 relative to the spaced rails 26 disposed within the central portion 72 of the rack 18. For example, the arcuate portions 102 curve generally upward from the forward and rearward crossbars 74, 78, and the linear portion 104 couples to the arcuate portions 102 and the first and second side rails 82, 86. Stated differently, the central portion 72 and the spaced rails 26 are generally depressed relative to at least a portion of the perimeter rim 20. Further, the perimeter rim 20 has the forward crossbar 74, which is contemplated to be generally planar with the central portion 72 and the spaced rails 26.

With further reference to FIGS. 1-6, the elongated member 28 is illustrated as at least partially extending along the forward crossbar 74. By way of example, not limitation, the elongated member 28 can extend along a length $L_1$ of the forward crossbar 74, such that the forward crossbar 74 can be at least partially concealed along the length $L_1$ of the forward crossbar 74 by the elongated member 28. In such configuration, a first side 110 and a second side 112 of the forward crossbar 74 are visible, while the central region 36 of the forward crossbar 74 is generally concealed. The elongated member 28 can be coupled to the forward crossbar 74 via retention features 116. By way of example, not limitation, the elongated member 28 is illustrated as having first and second retention features 116*a*, 116*b*. However, the elongated member 28 may include a single retention clip 116 or, optionally, a plurality of retention features 116. The retention features 116 may be clips, clasps, snaps, hooks, or other retention members generally known in the art.

Figure 3:
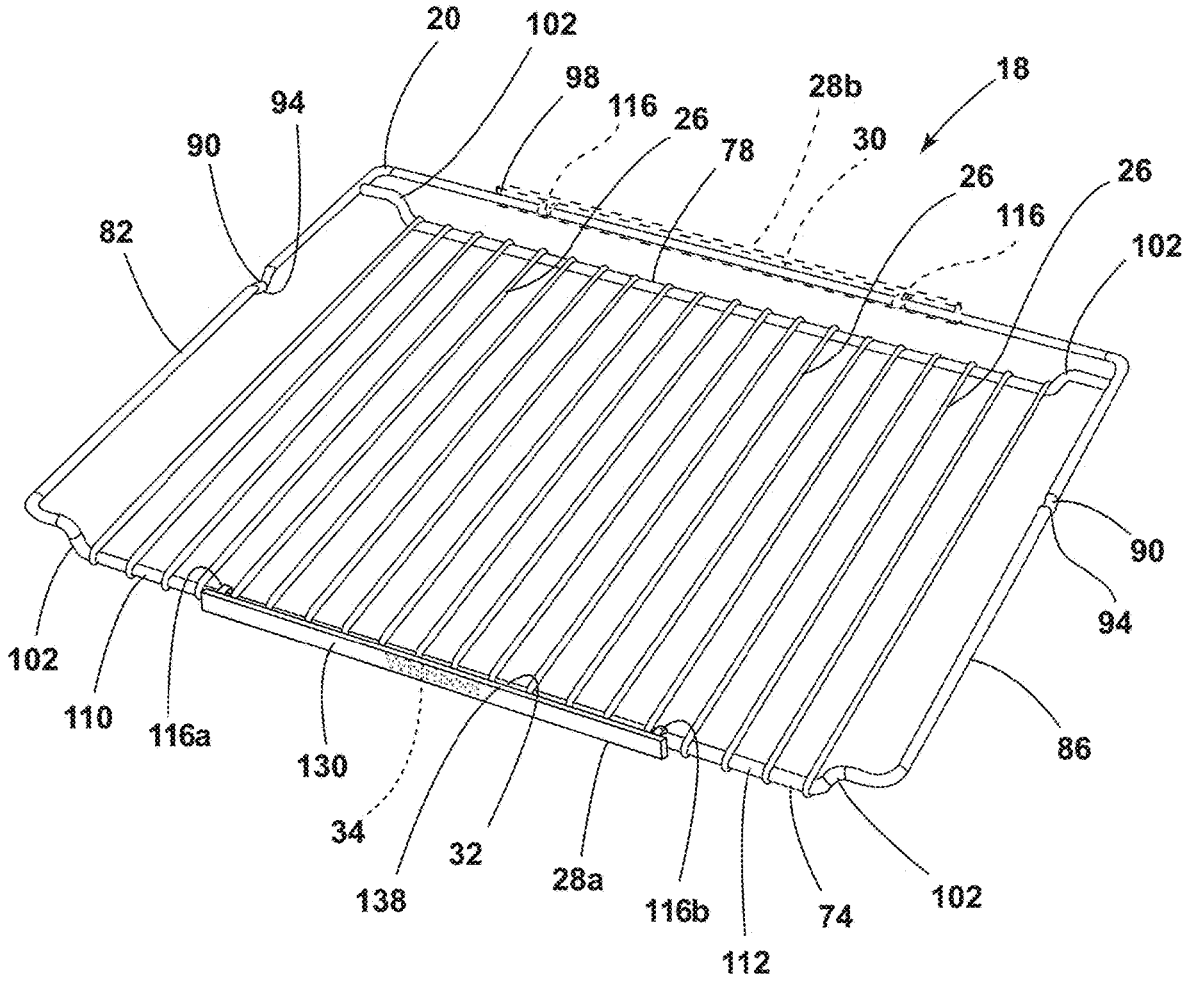
FIG. 3 is a top perspective view of a rack of the present disclosure that has a perimeter rim that is elevated relative to a plurality of spaced rails.
Figure 4:
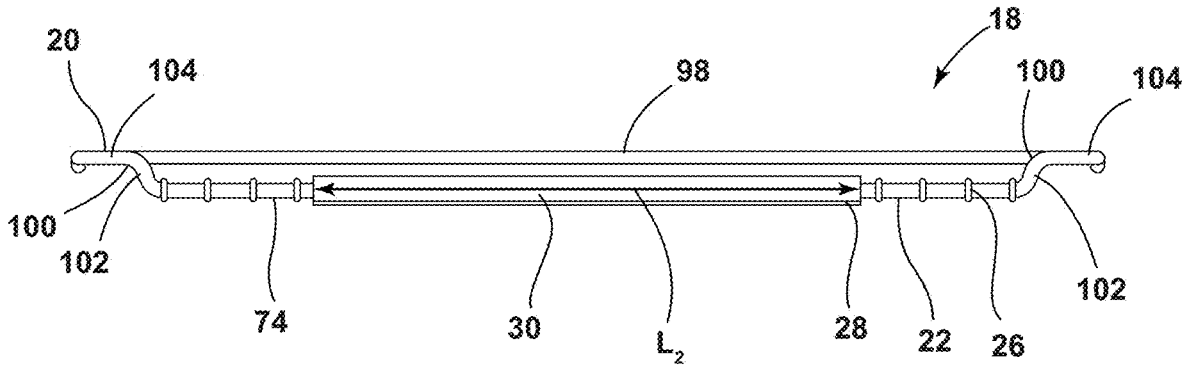
FIG. 4 is a front elevational view of an elongated member for a rack of the present disclosure.
Figure 5:
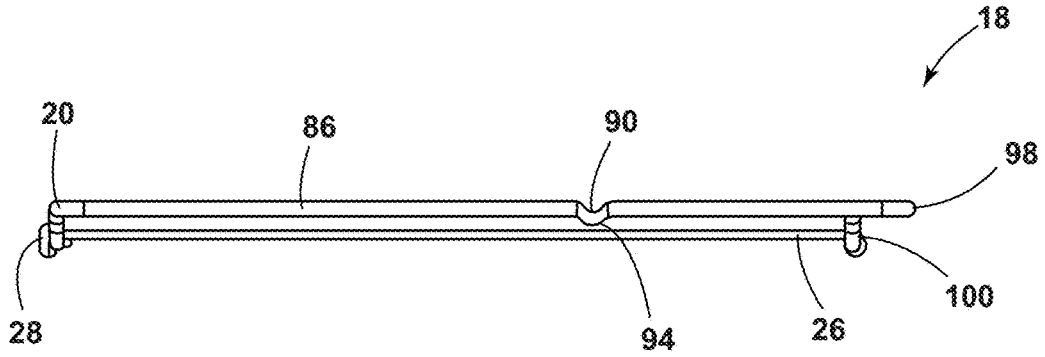
FIG. 5 is a side elevational view of a rack of the present disclosure.

As mentioned above, the elongated member 28 can be said to extend between the attachment features 100 of the first and second side rails 82, 86. The elongated member 28 is illustrated as being coupled to the forward crossbar 74. However, it is also contemplated that the elongated member 28 may be coupled to the arcuate portions 102 of the attachment features 100 to extend along and generally conceal the forward crossbar 74. Additionally or alternatively, the elongated member 28 may be operably coupled to the rearward crossbar 78 of the perimeter rim 20, as illustrated in phantom. For example, the elongated member 28 may include a first elongated member 28*a* and a second elongated member 28*b*, such that the first elongated member 28*a* is coupled to the forward crossbar 74 and the second elongated member 28*b* can be coupled to the rearward crossbar 78. It is also contemplated that the second elongated member 28*b* can be coupled to the support rail 98 disposed behind the rearward crossbar 78, as depicted in FIG. 3.

With further reference to FIGS. 1-6, the elongated member 28 includes a display surface 30 and an attachment surface 32, with the retention features 116 typically coupled to the attachment surface 32. The elongated member 28 is generally coupled to at least the forward crossbar 74 at the attachment surface 32 via the retention features 116. The display surface 30 of the elongated member 28 is configured to display the indicia 34, such as a logo, brand, brand name, and/or other descriptive indicia along a length $L_2$ of the elongated member 28. Additionally or alternatively, the indicia 34 may be formed by the elongated member 28. While the first elongated member 28*a* is typically coupled to the forward crossbar 74, it is generally contemplated that the second elongated member 28*b* is coupled to either the rearward crossbar 78 or the support rail 98. In such configuration, the display surface 30 is visible when the door 40 of the cooking appliance 10 is in an open position.

As illustrated in FIGS. 2-5, the display surface 30 and the attachment surface 32 of the elongated member 28 are generally defined by a perimeter edge 138 of the elongated member 28. In general, the perimeter edge 138 defines a boundary of the elongated member 28 that separates the display surface 30 and the attachment surface 32. The perimeter edge 138 may be a planar surface, such that the perimeter edge 138 may be generally orthogonal with the attachment surface 32 and the display surface 30. Additionally or alternatively, the perimeter edge 138 may have a curved edge, such that the boundary between the display surface 30 and/or the attachment surface 32 is integral with the perimeter edge 138. It is also contemplated that the display surface 30 may extend around a circumference $C_1$ of the elongated member 28, described in more detail below.

While the display surface 30 is typically defined as the surface display of the descriptive indicia 34, the attachment surface 32 of the second elongated member 28*b* may alternatively be the surface on which the descriptive indicia 34 are disposed. For example, the attachment surface 32 of the second elongated member 28*b* may include the descriptive indicia 34, described above, in addition to the descriptive indicia 34 disposed on the display surface 30. In one configuration, the display surface 30 is forward-facing relative to the cooking appliance 10 and the attachment surface 32 is rearward. In this configuration, the attachment surface 32 includes the retention features 116 to couple the second elongated member 28*b* to the support rail 98 when the second elongated member 28*b* is coupled to the support rail 98, and the descriptive indicia 34 may be disposed on both the attachment surface 32 and the display surface 30 of the second elongated member 28*b*. In either configuration of the second elongated member 28*b*, whether coupled to the rearward crossbar 78 or the support rail 98, the indicia can be disposed upon the second elongated member 28*b* to be visible when the door 40 of the cooking appliance 10 is in the open position.

Figure 6:
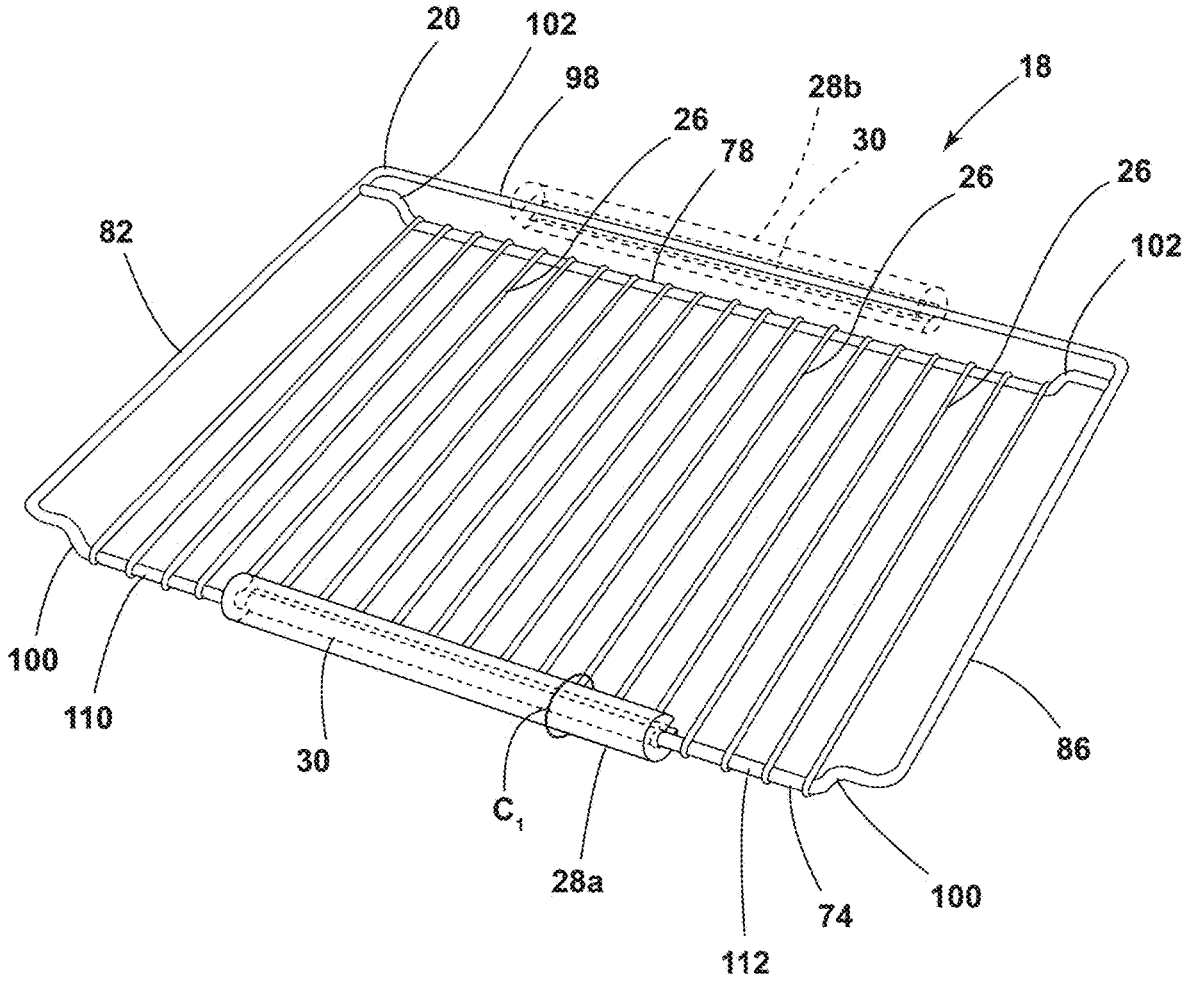
FIG. 6 is a top perspective view of an elongated member for a rack of the present disclosure.
Figure 7:
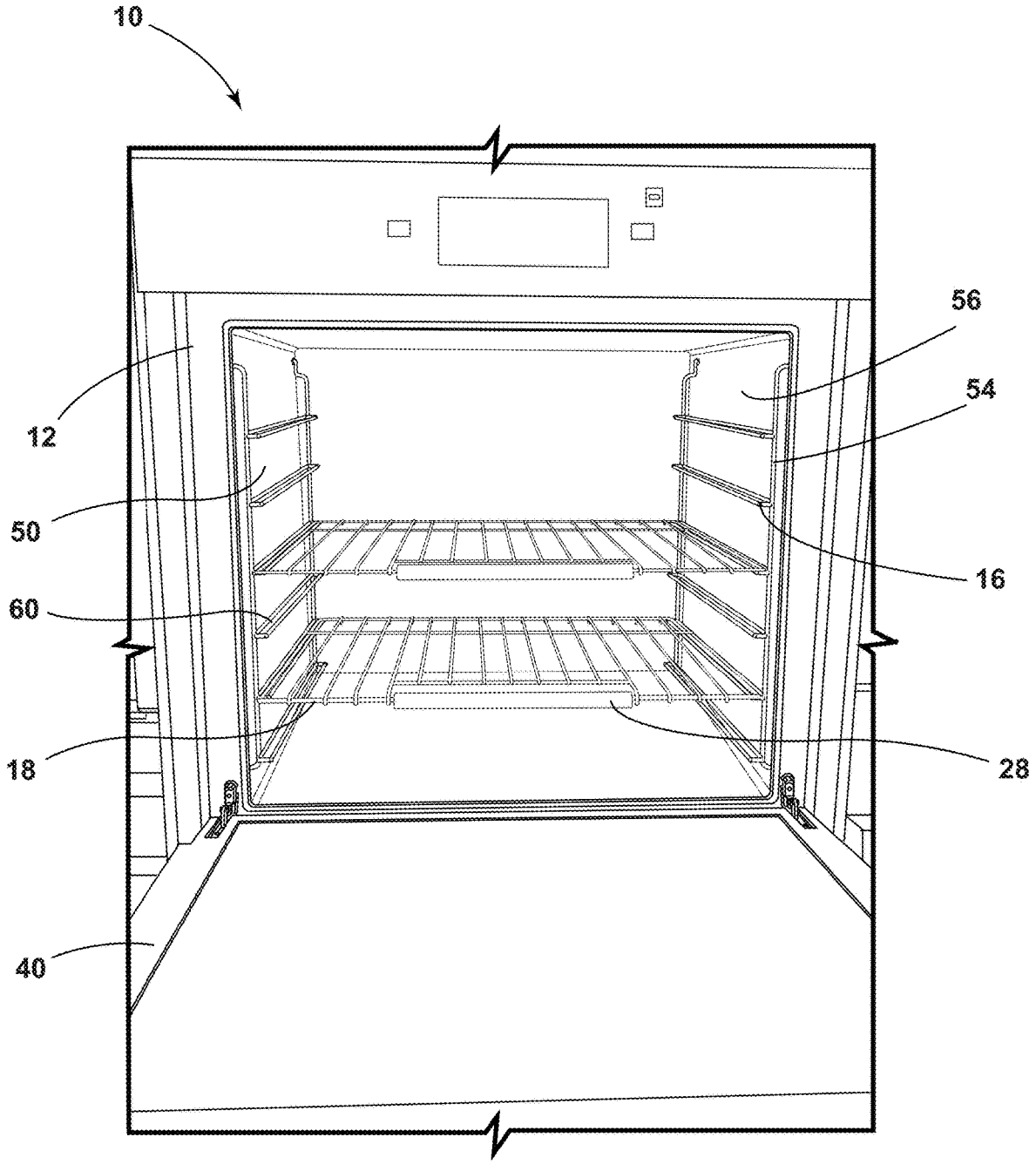
FIG. 7 is a front perspective view of racks of the present disclosure positioned within a cooking appliance.

As illustrated in FIG. 6, the elongated member 28 is wrapped around the forward crossbar 74 of the rack 18. The attachment surface 32 of the elongated member 28 illustrated in FIG. 6 as defining a groove 140 in which the forward crossbar 74 can be disposed. It is generally contemplated that the elongated member 28 can be formed from a flexible, insulation material, such as silicon, such that the elongated member 28 can be disposed around the forward crossbar 74. As mentioned above, the display surface 30 in this configuration is defined by the circumference $C_1$ of the elongated member 28. Stated differently, the indicia 34 can be disposed on the display surface 30 at various locations along the circumference $C_1$ of the elongated member 28.

Figure 8:
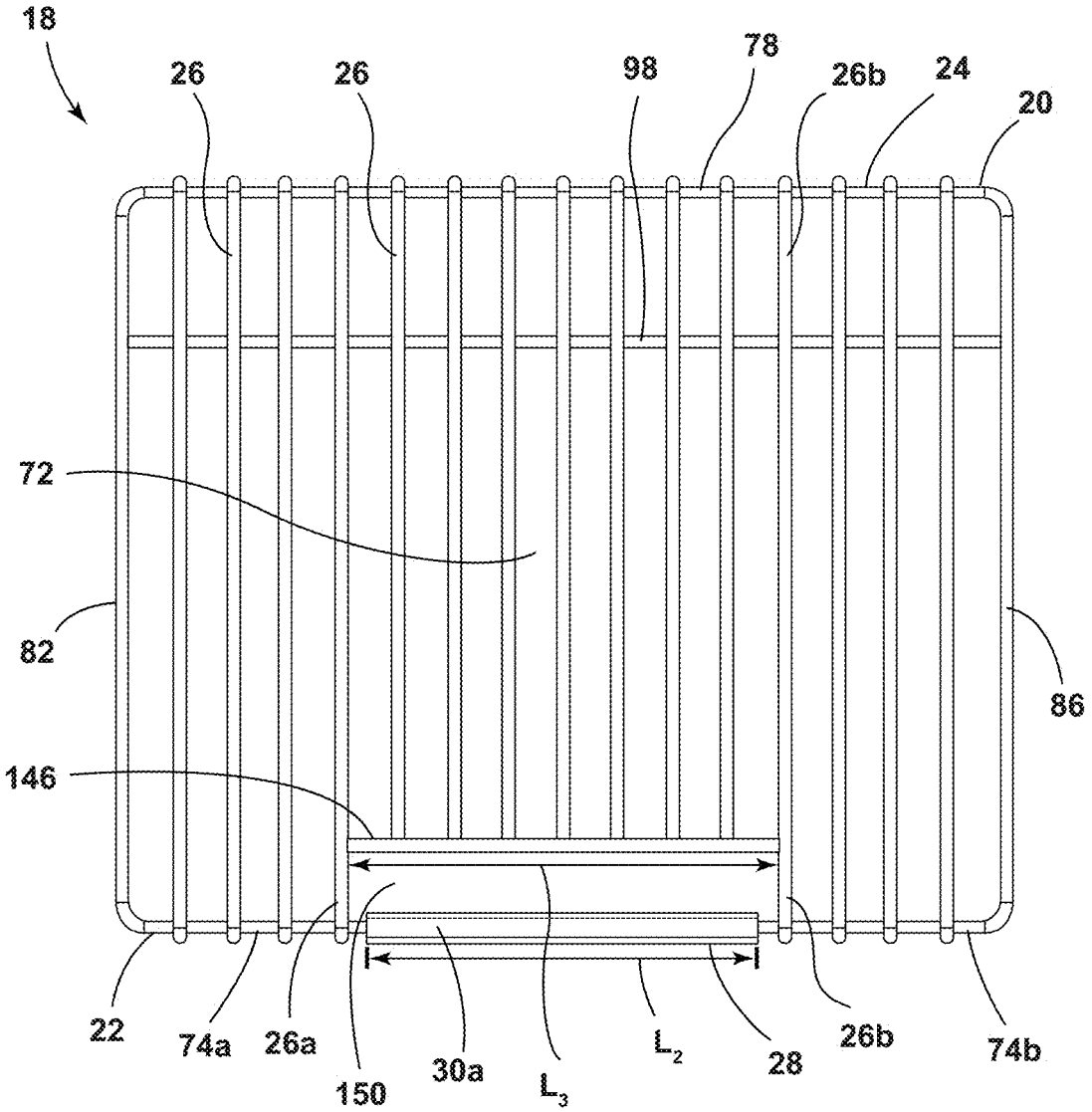
FIG. 8 is a top plan view of a rack of the present disclosure that has an elongated member disposed along a forward crossbar.
Figure 9:
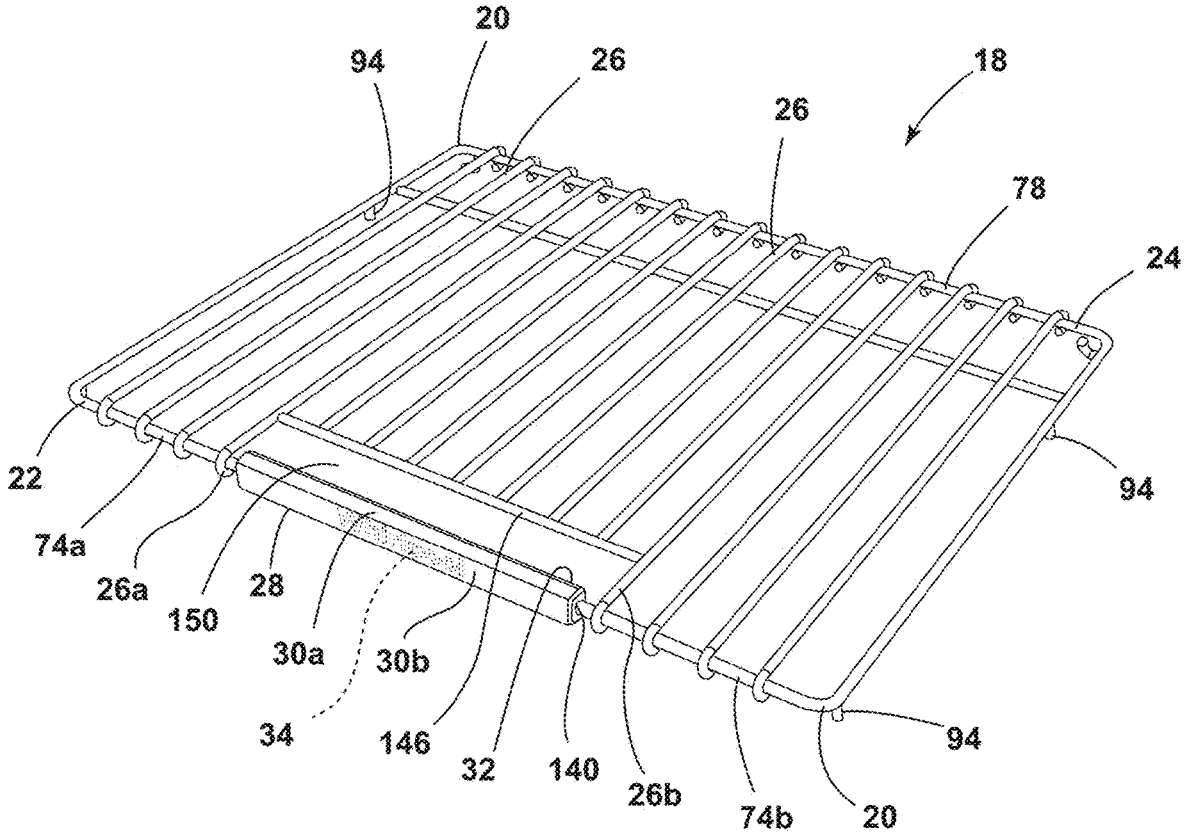
FIG. 9 is a top perspective view of a rack of the present disclosure with an opening defined between an elongated member and a cross member.
Figure 10:
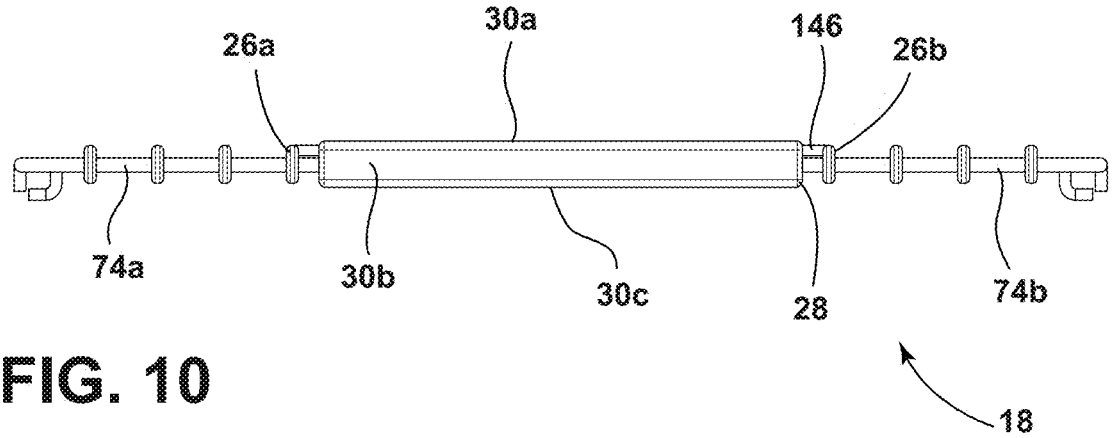
FIG. 10 is a front elevational view of an elongated member of the present disclosure.
Figure 11:
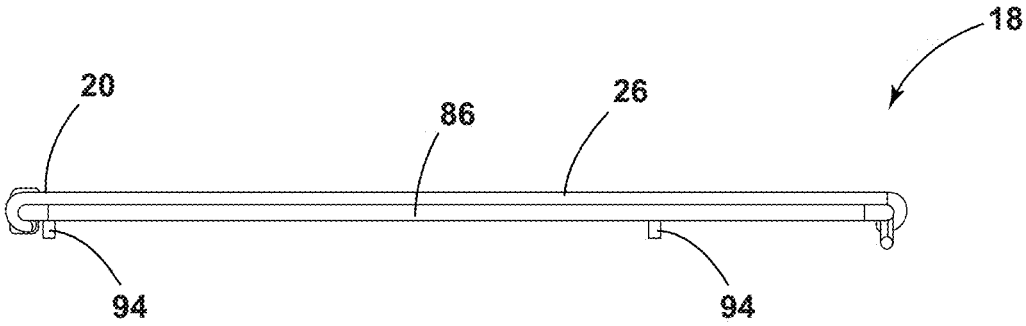
FIG. 11 is a side elevational view of a rack of the present disclosure.

Referring now to FIGS. 7-15, the rack 18 illustrated is generally defined within a single plane, such that the perimeter rim 20 and the spaced rails 26 are generally planar. As discussed above, the spaced rails 26 can extend around both the forward crossbar 74 and the rearward crossbar 78. Additionally, the support rail 98 is forward of the rearward crossbar 78. The support rail 98 is positioned, such that the spaced rails 26 extend above the support rail 98. It is also contemplated that the support rail 98 may be disposed above the spaced rails 26. As depicted in FIGS. 8 and 9, the support rail 98 is coupled to the spaced rails 26 spanning the central portion 72 of the rack 18.

The projections 94, as generally described above, are illustrated in FIGS. 9, 11, and 13 as pegs, which may be disposed within the recesses 60 of the first and second support racks 50, 54 positioned along the sides of the body 12 of the cooking appliance 10. Similar to the operation described above, the user lifts the rack 18 relative to the first and second support racks 50, 54 to remove the pegs from the recesses 60 defined by the retention rails 16. As opposed to the projections 94 depicted in FIGS. 3 and 5, the pegs are generally disposed at both the first end 22 and the second end 24 of the perimeter rim 20. Additionally or alternatively, the projections 94 may be disposed along any portion of the first and second side rails 82, 86 of the perimeter rim 20.

With further reference to FIGS. 7-15 and as also described above with respect to FIGS. 2-4, the spaced rails 26 may extend around the first and second ends 22, 24 of the perimeter rim 20. Comparatively, in FIGS. 8-10 and 12-14, the spaced rails 26 may both extend around the first and second ends 22, 24 as well as abut and couple to a cross member 146. The cross member 146 is generally centrally and forwardly disposed on the rack 18 and extends between a first rail 26*a* and a second rail 26*b* of the plurality of spaced rails 26. The cross member 146 generally corresponds to the length $L_2$ of the elongated member 28, such that a length $L_3$ of the cross member 146 is generally similar to the length $L_2$ of the elongated member 28. Additionally or alternatively, the length $L_3$ of the cross member 146 may differ from the length $L_2$ of the elongated member 28. The arrangement of the elongated member 28 and the cross member 146, along with the first and second rails 26*a*, 26*b*, defines an opening 150 disposed directly behind the elongated member 28 and along the lengths $L_2$, $L_3$ of the elongated member 28 and the cross member 146, respectively.

Figure 12:
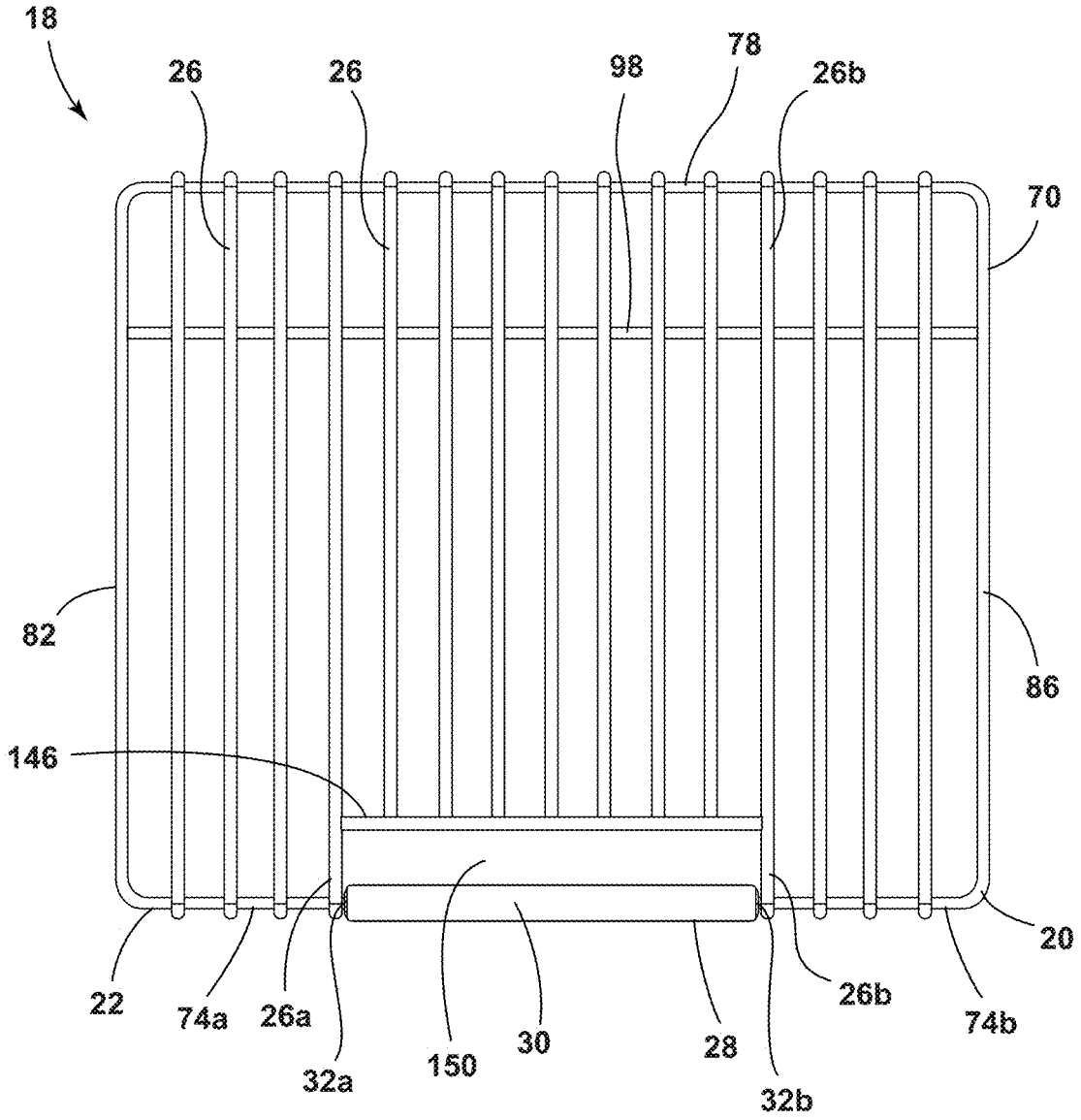
FIG. 12 is a top plan view of a rack of the present disclosure that has an elongated member integrally formed with a perimeter rim of the rack.
Figure 13:
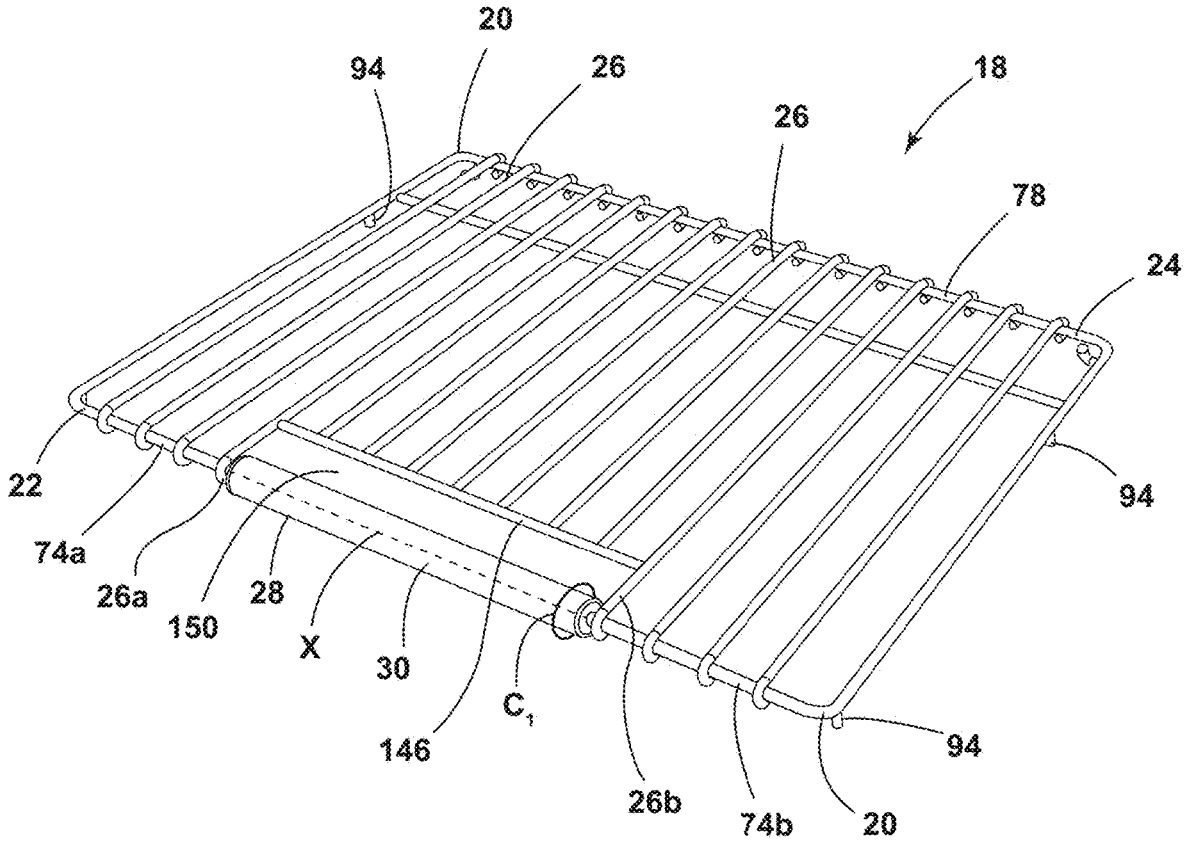
FIG. 13 is a top perspective view of a rack of the present disclosure with an opening defined between an elongated member and a cross member.
Figure 14:
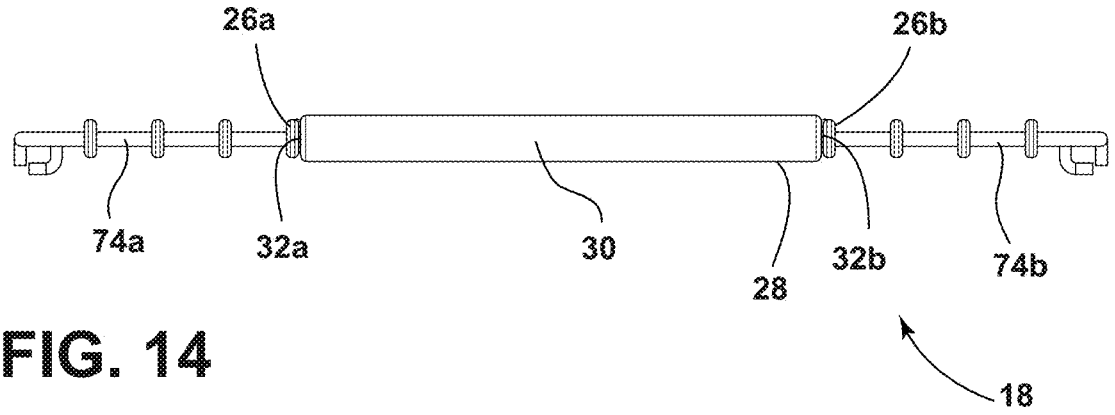
FIG. 14 is a front elevational view of an elongated member of the present disclosure disposed between a first forward crossbar and a second forward crossbar.
Figure 15:
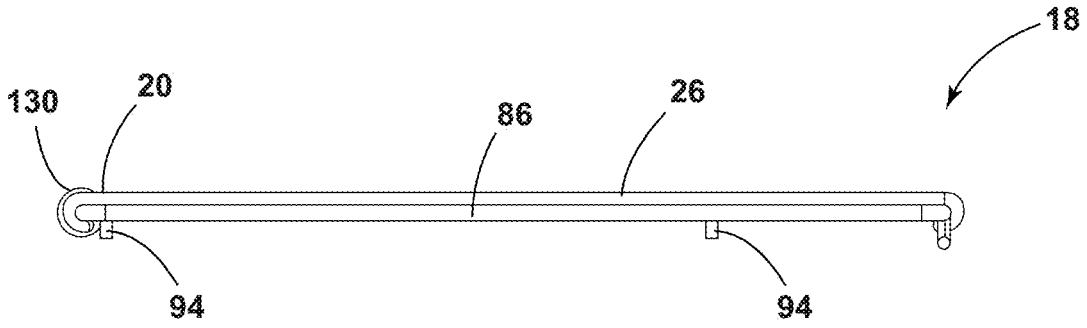
FIG. 15 is a side elevational view of a rack of the present disclosure.

In operation, a user may grasp the elongated member 28 through the opening 150 defined behind the elongated member 28 and proximate to the cross member 146. Typically, when the elongated member 28 is used as a handle, as described, the elongated member 28 is formed from the insulation material that has low thermal conductivity. However, as discussed above, it is also contemplated that the elongated member 28 may be formed from the same material as the rack 18. When the rack 18 and the elongated member 28 are formed from the same material, it is contemplated that the elongated member 28 is integrally formed with the rack 18, as illustrated in FIGS. 12-14. With such integration, the user typically utilizes some form of insulating material in order to grasp the elongated member 28 to minimize potential contact with a thermally conductive material.

Referring now to FIGS. 8-11, the attachment surface 32 of the elongated member 28 defines the groove 140, mentioned above, that is configured to receive the forward crossbar 74 of the perimeter rim 20. In such configuration, the elongated member 28 is configured to snap-fit to the forward crossbar 74 of the perimeter rim 20. While the elongated member 28 may be removably coupled to the forward crossbar 74, it is generally contemplated that the elongated member 28 remains fixedly coupled to the forward crossbar 74. Thus, the elongated member 28 remains securely attached to the perimeter rim 20 during articulation of the rack 18.

The display surface 30 may extend around the elongated member 28, such that the display surface 30 may correspond to the previously described perimeter edge 138 (FIG. 2) of the elongated member 28. Accordingly, the descriptive indicia 34 may be disposed along an upper display surface 30*a*, a front display surface 30*b*, and a lower display surface 30*c* of the elongated member 28. The additional display surfaces 30*a*-30*c* of the elongated member 28 provide additional space upon which descriptive indicia 34 may be disposed. For example, a brand name may be disposed along the front display surface 30*b*, while the brand logo or other image-based indicia may be disposed along the upper and/or lower display surfaces 30*a*, 30*c* of the elongated member 28. Additionally or alternatively, the brand logo or other image-based indicia may be disposed along the front display surface 30*b*, and the brand name may be disposed along the upper and/or lower display surfaces 30*a*, 30*c*. The additional display surfaces 30*a*-30*c* provides an increased area of display for the brand information and/or other descriptive indicia 34 to be displayed on the elongated member 28 via one of the display surfaces 30*a*-30*c*. However, the indicia 34 are not limited by the arrangements relative to the display surfaces 30*a*-30*c* as described above.

As depicted in FIG. 9, the elongated member 28 generally forms a C-shape, which helps to define the groove 140 along the attachment surface 32 of the elongated member 28. The elongated member 28 depicted in FIGS. 8-10 has a generally rectangular and angular shape, such that each of the display surfaces 30*a*-30*c* are clearly defined. Additionally or alternatively, the display surface 30 of the elongated member 28 may be generally arcuate relative to the first end 22 of the perimeter rim 20, similar to the elongated member 28 depicted in FIGS. 12-14, described in more detail below. The arcuate display surface 30 can partially extend around a circumference $C_1$ (FIG. 13) of the elongated member 28. Accordingly, the descriptive indicia 34 may extend along the arcuate display surface 30, while the elongated member 28 is operably coupled to the forward crossbar 74 via the groove 140 defined by the attachment surface 32, in contrast to the construction of the elongated member 28 described in further detail with reference to FIGS. 12-15.

Referring now to FIGS. 12-15, the elongated member 28 may be integrally formed with the perimeter rim 20, such that the forward crossbar 74 includes a first forward crossbar 74*a* and a second forward crossbar 74*b* with the elongated member 28 disposed therebetween. In such construction, the first and second rails 26*a*, 26*b* of the plurality of spaced rails 26 are also coupled to the elongated member 28 at a first attachment surface 32*a* and a second attachment surface 32*b*, respectively. The elongated member 28 can be generally cylindrical such that the display surface 30 extends around the circumference $C_1$ of the elongated member 28. Accordingly, the indicia 34 described above may be disposed along any portion of the elongated member 28. Stated differently, the indicia 34 may be disposed along the display surface 30 and generally around the elongated member 28, as the display surface 30 generally wraps around the circumference $C_1$ of the elongated member 28.

Rather than couple via retention features 116 (FIG. 2), the elongated member 28 depicted in FIG. 12 couples to the first and second rails 26*a*, 26*b* at the respective first and second attachment surfaces 32*a*, 32*b*. It is generally contemplated that the elongated member 28 may be integrally formed with the perimeter rim 20 at the first and second attachment surfaces 32*a*, 32*b*. As a result of this integration of the elongated member 28, the first and second forward crossbars 74*a*, 74*b* are separated from one another by the elongated member 28. Accordingly, the elongated member 28, as illustrated, at least partially defines the frame 70 as part of the perimeter rim 20.

Referring still to FIGS. 12-15, it is also contemplated that the elongated member 28 may be rotatably coupled to the first and second forward crossbars 74*a*, 74*b* of the perimeter rim 20, such that the display surface 30 may rotate about an axis X relative to the first and second forward crossbars 74*a*, 74*b*. As the display surface 30 may rotate relative the first and second forward crossbars 74*a*, 74*b*, the descriptive indicia 34 located on the display surface 30 may also rotate, such that regardless of the repositioning of the display surface 30 the indicia may be visible to the user.

With further reference to FIGS. 1-15, it is generally advantageous that the elongated member 28 provides a display surface 30 upon which a brand, logo, and/or other descriptive indicia 34 may be displayed, such that a user may readily identify the associated brand via the elongated member 28. Moreover, the elongated member 28 may provide decorative advantages for the rack 18 when positioned within the body 12 of the cooking appliance 10. For example, when placing items in the cooking appliance 10, a user can readily identify the brand of the cooking appliance 10 based on the indicia 34 located on the display surface 30 of the elongated member 28. The elongated member 28 can also provide the user with a readily identifiable area to grasp the rack 18 when articulating the rack 18 relative to the body 12 of the cooking appliance 10.

According to one aspect of the present disclosure, a cooking appliance includes a body that defines a cavity and a plurality of retention rails. A rack is operably coupled to the retention rails of the body within the cavity. The rack includes a perimeter rim that has a first end and a second end. A plurality of spaced rails are disposed between the first end and the second end of the perimeter rim, and an elongated member includes a display surface, an attachment surface, and an indicia disposed on the display surface. The elongated member is operably coupled to a central region of the first end of the perimeter rim proximate to the plurality of spaced rails via the attachment surface and divides the first end at the central region.

According to another aspect, an elongated member is formed from an insulation material.

According to another aspect, an elongated member includes retention features that are disposed on the attachment surface.

According to another aspect, a display surface includes a first display surface and a second display surface. An indicia is disposed on each of the first display surface and the second display surface.

According to another aspect, an elongated member is operably coupled to a perimeter rim of a rack via retention features.

According to another aspect, an attachment surface that defines a groove along a length of the elongated member.

According to another aspect, a perimeter rim of a rack is disposed within a groove of an attachment surface.

According to another aspect of the present disclosure, an appliance includes a body that defines a cavity and includes a first retention rail and a second retention rail. A rack has a first side rail that is operably coupled to the first retention rail, and a second retention side rail that is operably coupled to the second retention rail. The rack includes a plurality of spaced rails that are disposed between the first and second side rails of the rack. An elongated member is operably coupled to the rack that is proximate to the plurality of spaced rails. The elongated member includes an attachment surface and a display surface separated by a perimeter edge According to another aspect, a rack includes attachment features, a forward crossbar, and a rearward crossbar. The attachment features couple each first and second side rail to each of the forward and rearward crossbars.

According to another aspect, a rack includes a perimeter rim, and at least a portion of the perimeter rim is disposed above an elongated member and a plurality of spaced rails of a rack via attachment features.

According to another aspect, a rack defines an opening that is disposed behind an elongated member and along a length of the elongated member and a length of the rack.

According to another aspect, an elongated member is comprised of an insulation material.

According to another aspect, an attachment surface defines a groove along a length of the elongated member.

According to another aspect, a perimeter rim of a rack is disposed within a groove of an attachment surface.

According to another aspect of the present disclosure, a rack for a cooking appliance includes a perimeter rim that has a first end, a second end, a first side rail, and a second side rail. A plurality of spaced rails are disposed between each of the first and second rails and the first and second ends of the perimeter rim. An elongated member is operably coupled to the perimeter rim and is proximate to the plurality of spaced rails. A crossbar is disposed proximate to the elongated member. The crossbar defines an opening directly behind the elongated member along a length of the elongated member and a length of the crossbar.

According to another aspect, an elongated member includes a display surface and an attachment surface.

According to another aspect, an indicia is disposed on a display surface of an elongated member.

According to another aspect, an elongated member includes a perimeter edge that separates a display surface and an attachment surface.

According to another aspect, a display surface extends around a circumference of an elongated member.

According to another aspect, an elongated member includes an attachment surface that defines a groove along a length of the elongated member. The elongated member is coupled to a perimeter rim via a groove of an attachment surface.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance, comprising:

a body defining a cavity and a plurality of retention rails; and a rack operably coupled to the retention rails of the body within the cavity, the rack including:

a perimeter rim having a first end and a second end;

a plurality of spaced rails disposed between the first end and the second end of the perimeter rim;

a first elongated member; and a second elongated member, wherein the first elongated member and the second elongated member each include a display surface, an attachment surface, and an indicia, wherein the first elongated member is operably coupled to a central region of the first end of the perimeter rim proximate to the plurality of spaced rails via the attachment surface of the first elongated member and divides the first end at the central region, wherein the indicia of the first elongated member is positioned on the display surface of the first elongated member, wherein the second elongated member is operably coupled to the second end of the perimeter rim proximate to the plurality of spaced rails via the attachment surface of the second elongated member, and wherein the indicia of the second elongated member is positioned on the attachment surface of the second elongated member.

2. The cooking appliance of claim 1, wherein at least one of the first elongated member and the second elongated member is formed from an insulation material.

3. The cooking appliance of claim 1, wherein at least one of the first elongated member and the second elongated member includes retention features disposed on the attachment surface thereof.

4. The cooking appliance of claim 3, wherein the at least one of the first elongated member and the second elongated member is operably coupled to the perimeter rim of the rack via the retention features.

5. The cooking appliance of claim 1, wherein the display surface of at least one of the first elongated member and the second elongated member includes a first display surface and a second display surface, and wherein the corresponding indicia is disposed on each of the first display surface and the second display surface.

6. The cooking appliance of claim 1, wherein the attachment surface of at least one of the first elongated member and the second elongated member defines a groove along a length thereof.

7. The cooking appliance of claim 6, wherein the perimeter rim of the rack is disposed within the groove of the attachment surface.

8. The cooking appliance of claim 1, wherein the rack and the second elongated member are made from the same material.

9. The cooking appliance of claim 8, wherein the material that the rack and the second elongated member are made from is a metallic material.

10. An appliance, comprising:

a body defining a cavity and including a first retention rail and a second retention rail;

a rack having a first side rail operably coupled to the first retention rail and a second side rail operably coupled to the second retention rail, the rack including a plurality of spaced rails disposed between the first and second side rails of the rack, wherein the rack includes attachment features, a forward crossbar, and a rearward crossbar, wherein the attachment features couple each of the first and second side rails to each of the forward and rearward crossbars, wherein the rack includes a perimeter rim, and wherein the rack is made of a first material; and an elongated member operably coupled to the rack proximate to the plurality of spaced rails, the elongated member including an attachment surface and a display surface separated by a perimeter edge, wherein the elongated member is also made of the first material, and wherein at least a portion of the perimeter rim of the rack is disposed above the elongated member and the plurality of spaced rails of the rack via the attachment features.

11. The appliance of claim 10, wherein the rack defines an opening disposed behind the elongated member, and wherein the opening is disposed along a length of the elongated member and a length of the rack.

12. The appliance of claim 10, wherein a second material is molded onto the elongated member, and wherein the second material is an insulation material.

13. The appliance of claim 10, wherein the attachment surface defines a groove along a length of the elongated member.

14. The appliance of claim 13, wherein a perimeter rim of the rack is disposed within the groove of the attachment surface.

15. A rack for a cooking appliance, comprising:

a perimeter rim having a first end, a second end, a first side rail, and a second side rail;

a plurality of spaced rails disposed between each of the first and second side rails and the first and second ends of the perimeter rim;

a first elongated member operably coupled to the perimeter rim and proximate to the plurality of spaced rails at the first end, wherein the first elongated member includes a first display surface and a first attachment surface, and wherein a first indicia is provided on the first display surface;

a second elongated member operably coupled to the perimeter rim at the second end, wherein the second elongated member includes a second display surface and a second attachment surface, and wherein a second indicia is provided on the second attachment surface; and a crossbar disposed proximate to the elongated member and defining an opening directly behind the elongated member, wherein the opening is disposed along a length of the elongated member and a length of the crossbar.

16. The rack of claim 15, wherein the first elongated member and the second elongated member each include a perimeter edge that separates the display surface and the attachment surface.

17. The rack of claim 15, wherein the first display surface extends around a circumference of the first elongated member.

18. The rack of claim 15, wherein the first attachment surface defines a groove along a length of the first elongated member, and wherein the first elongated member is coupled to the perimeter rim via the groove of the first attachment surface.

* * * * *